United States Patent [19]

Aurich et al.

[11] 4,036,038

[45] July 19, 1977

[54] APPARATUS FOR LOW LIQUOR RATIO WET PROCESSING OF TEXTILE FABRIC

[75] Inventors: Christoph W. Aurich, Clemson, S.C.; William Cleere Sturkey, Charlotte; James Keith Turner, Lincolnton, both of N.C.

[73] Assignee: Gaston County Dyeing Machine Company, Stanley, N.C.

[21] Appl. No.: 688,189

[22] Filed: May 20, 1976

[51] Int. Cl.[2] ..... D06B 3/28

[52] U.S. Cl. ..... 68/5 C; 68/178; 165/158

[58] Field of Search ..... 68/5 C, 177, 178, 179; 165/158

[56] References Cited

U.S. PATENT DOCUMENTS

| | | | |
|---|---|---|---|
| 3,599,447 | 8/1971 | Arashi | 68/177 |
| 3,685,325 | 8/1972 | Carpenter | 68/177 |
| 3,686,901 | 8/1972 | Vihl | 68/177 X |
| 3,921,420 | 11/1975 | Aurich et al. | 68/178 X |

FOREIGN PATENT DOCUMENTS

| | | | |
|---|---|---|---|
| 2,413,806 | 10/1974 | Germany | 68/177 |

*Primary Examiner*—Philip R. Coe

[57] ABSTRACT

Apparatus is provided for effective low liquor wet processing of textile piece goods with exceptional flexibility as to type of fabric that may be handled and processing conditions that may be applied.

11 Claims, 10 Drawing Figures

54
46
44
60
56
42
40
14
58
20'
20
68
64
24
24'
16
62
10
38
12
70

APPARATUS FOR LOW LIQUOR RATIO WET PROCESSING OF TEXTILE FABRIC

BACKGROUND OF THE INVENTION

At 88, 9–14 of the Journal of the Society of Dyers and Colourists (Jan. 1972), an aqueous dyeing system is described in which exceptionally short liquor ratios are employed by formulating the dyestuff with a foaming agent and converting th liquor to a foam on and in the substrate before raising temperature to fix the color.

Considerable interest has since developed in applying short liquor ratio techniques of this sort to piece goods wet processing, because of substantial operating economics that are potentially available, but progress in this field has been hampered by difficulties encountered in handling adequate piece good loads without inducing crush marks and other objectionable adverse influences in the piece goods as it is handled for wet processing at low liquor ratios. Such difficulties are eliminated according to the present invention by expanding the effective handling influence of the processing liquor at low liquor ratios by applying a foaming formulation of the processing liquor in a non-persistently foamed condition so that a portion of the processing liquor continually decays to liquid phase during the piece goods handling and can be recovered and continually recycle for reapplication during the wet processing treatment.

SUMMARY OF THE INVENTION

For this purpose, the low liquor ratio processing apparatus of the present invention is provided to handle the fabric piece goods to be treated in endless loop form while recirculatng it through a processing system that includes a vessel arranged for transiently storing a major portion of the fabric loop, together with a superstructure for the vessel disposed and equipped for progressively withdrawing the fabric loop from and returning it to the vessel storage to effect the fabric recirculation. A lifter roll and selectively operable aspirating means are housed in the vessel superstructure for effecting the fabric recirculation.

Effective wet processing is accomplished at a liquor ratio (i.e. ratio of fabric substrate weight to weight of treating liquor) not exceeding about 1:5. Means is provided for applying a foaming formulation of the processing liquor externally to the recriculating fabric adjacent the point of fabric return to the vessel storage. The foaming formulation of th processing liquor is employed in a non-persistently foamed condition so that the foamed liquor tends to decay to liquid phase in the course of migratory saturation of the storaed fabric as it progresses through the processing vessel.

The foaming formulation of the processing liquor is prepared by suitable additions of any of the great variety of such agents that are readily available for this purpose, such as those identified in the foregoing citation from the Journal of the Society of Dyers and Colourists. The foaming agent addition is made so as to obtain the non-persistently foamed condition of the processing liquor previously noted, and where significantly elevated temperatures are employed during the processing cycle a range of foaming agents is used having selected cloud points serving to maintain the non-persistently foaming condition of the liquor throughout the cycle. The term cloud point is used in this connection to indicate the point at which a foaming agent loses its ability to foam as temperature increases. An exemplary selection of foaming agents for a processing cycle in which temperatures about 212° F. are required might representatively include a first agent having a cloud point in the range of about 90–100° F., a second one having a cloud point of about 190° F., and a third one having an infinite cloud point, used in such combination as to produce effective foaming of the processing liquor during the entire cycle.

The processing system of the present invention is additionally arranged to recover a decayed liquid phase of the foamed processing liquor from the processing vessel and continually recycle the recovered liquor to the applying means for reapplication in non-persistently foamed condition to the recirculating fabric. The arrangements for application and recycling of the processing liquor are specially provided as described at further length below to allow exceptional flexibility in regulating the processding conditions to the best advantage for handling any particular form or type of fabric that must be dealt with and thereby provide for effective wet processing of a complete range of fabric materials.

DETAILED DESCRIPTION OF THE INVENTION

Because the low liquor ratio wet processing carried out according to the present invention is accomplished with not more than about one-fourth the amount of treating liquor normally employed in prior art jet processing of textile piece goods in rope form, the apparatus arrangement of the present invention incorporates a number of special features for employing the limited treating liquor amount available at particularly effective advantage, and which features also provide an exceptional flexibility in selection of the particular processing conditions to be applied, as will appear more fully further below.

Figure 1:
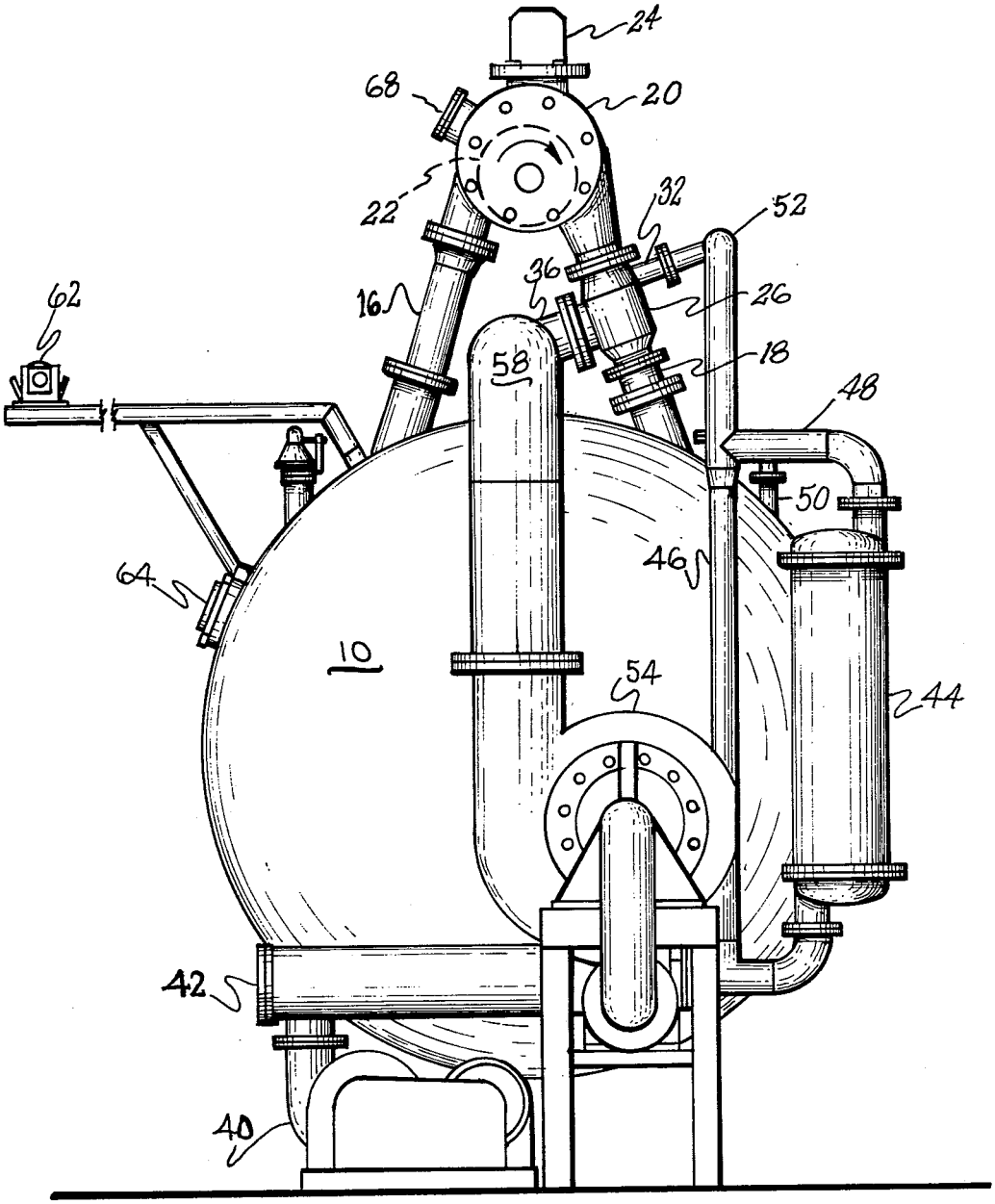
FIG. 1 is an end elevation of representative wet processing apparatus embodying the present invention.
Figure 2:
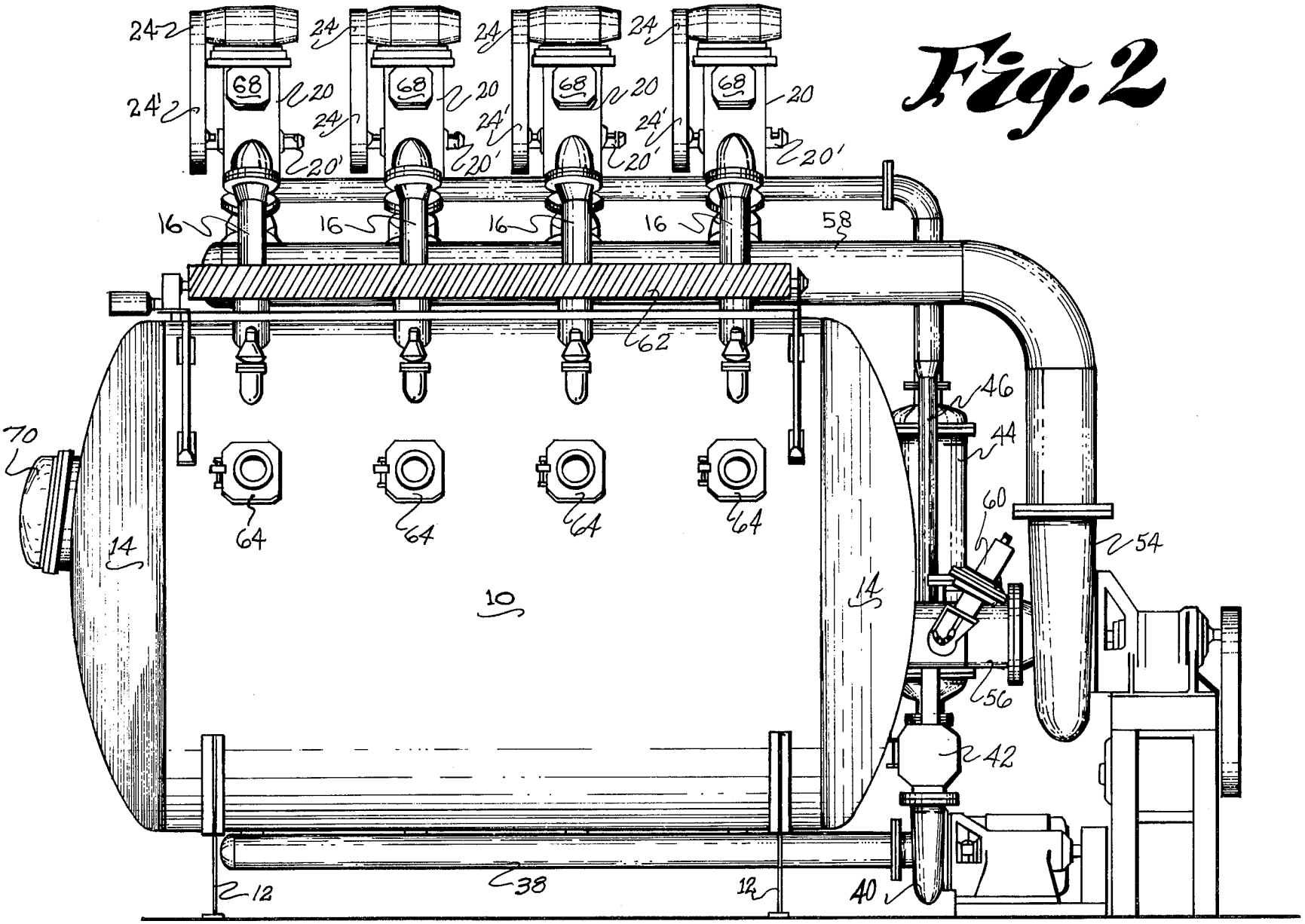
FIG. 2 is a left side elevation corresponding to FIG. 1.

FIGS. 1 and 2 of the drawings show the general arrangement of apparatus suited for use according to the present invention as comprising a processing vessel or kier 10 of cylindrical form that is mounted on suitable standards 12 and normally fitted at each end with dished heads 14 of usual pressure-resisting form so as to form the vessel or kier 10 for high temperature processing. Alternatively, where the processing comtemplated is all to be done below the boil the vessel 10 will need to be formed for dealing only with atmospheric conditions and its ends may be closed simply by installing flat plates thereat (not shown) without requiring pressure heads as indicated at 14.

The apparatus shown representatively in FIGS. 1 and 2 is arranged with four processing stations at each of which a superstructure is provided that houses means for circulating the textile piece goods rope during processing. This superstructure in each instance comprises respective intake and discharge leg portions 16 and 18 that are symmetrically inclined upwardly from the vessel 10 and are joined at their upper ends through a cylindrical housing 20 in which a lifter roll is rotatably disposed, as indicated at 22, for operation to progressively withdraw a fabric rope being processed form the vessel 10 through the intake leg portion 16 and deliver it to the discharge leg portion 18 for return to vessel 10 in which arrangements are provided, as described further below, for transiently storing a major portion of the textile piece goods rope during treatment thereof.

The lifter roll 22 housed at 20 in the vessel superstructure is provided in a form affording adequate traction for causing recirculating travel of the piece goods rope from the vessel 10 through the superstructue and discharging return thereto. Preferably the lifter roll 22 has a form corresponding to that disclosed and claimed in copending application Ser. No. 651,129 filed Jan. 12, 1976, in which the roll structure shown is characterized by alternately inclined spaced vanes having projected profiles that cross intermediate their length and formed with outwardly directed vane edges that are shaped with a gently undulate configuration so as to provide exceptionally good feeding traction. The superstructue housing portion 20 is fitted with bearing means 20' at which the lifter roll 22 is supported for rotation and a motor drive 24 is mounted on top of housing portion 20 with a drive connection 24' running therefrom to operate lifter roll 22.

Figure 7:
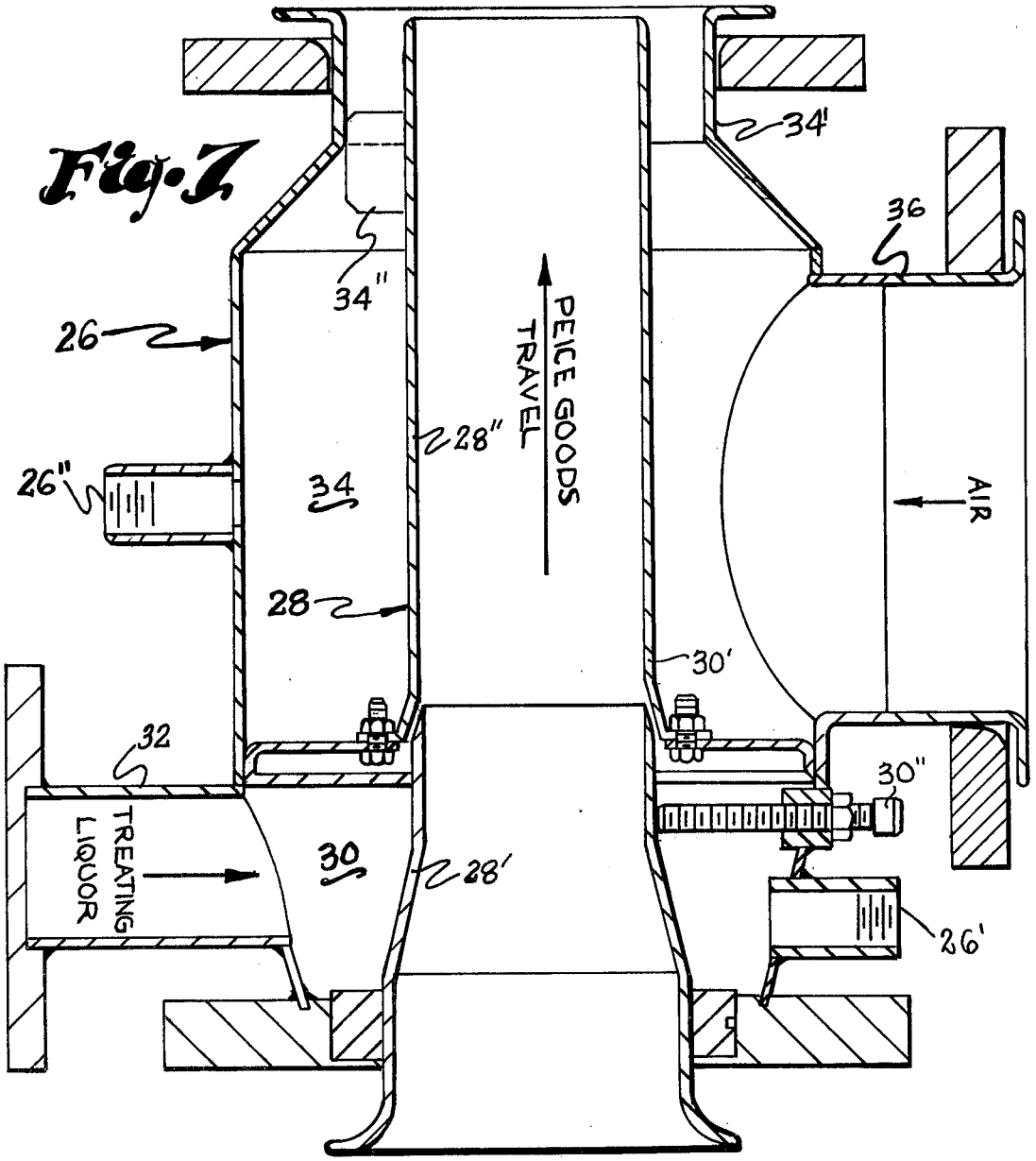
FIG. 7 is a detail of the aspirating means arranged in the vessel superstructure.

Additionally, the superstructure discharge leg portion 18 incorporates a two-stage aspirating device 26 that is specially arranged for selective operable use in directing continued recirculating travel of the piece goods rope as it is delivered by the lifter roll 22 and returned therefrom to the vessel 10. The special arrangement of the aspirating device 26 is shown in particular detail in FIG. 7 as comprising a two-part cloth tube 28 through which the piece goods rope is drawn during return to vessel 10 from the lifter roll 22.

An initial part 28' of this cloth tube 28 is formed with a tapered exit end portion concentrically spaced within a correspondingly tapered housing portion 30' to form a jet nozzle through which treating liquor may be delivered from a first plenum chamber 30 surrounding this initial cloth tube part 28' and supplied through a feed connection 32 thereto.

The cloth tube 28 also includes a terminal part 28'' that is surrounded by a second plenum chamber 34 to which air or other inert gas may be supplied from a feed connection 36 thereat. The term "inert gas" is used in the foregoing connection to mean that the gas employed is inert with respect to the textile fabric being treated or any treating liquor being employed in the sense of having no unwanted reactive or other effect thereon. Normally the gas employed will be air, although a gas that is inert in the strict sense, such as nitrogen, can be used whenever there is reason to do so. An exit end portion of the terminal cloth tube part 28'' is concentrically spaced within a tubular outlet housing portion 34' from the second plenum chamber 34, and at which terminal end portion a plurality of parallel flow directing vanes 34'' are disposed at 120° spacings both to maintain the concentricity of terminal cloth tube part 28'' and to combat any swirling tendency that may be present in the air discharge from the second plenum chamber 34. Concentricity of the initial cloth tube part 28' is provided for by spacing screws 30'' installed 120° apart in the wall of the first plenum chamber 30 for this purpose. The aspirating device 26 is also fitted as at 26' and 26'' for installation of pressure gages at each of the plenum chambers 30 and 34 for suitable monitoring of the device during operation as described futher below.

A particular advantage of the foregoing two-stage aspirating device 26 is the manner in which it can be employed to eliminate troublesome difficulty with ballooning of tubular piece goods during jet treatment thereof when air or inert gas is used as a transport fluid for causng circulation of the goods. The ballooning of such goods tends to initiate backwardly from an air jet and then to spread forwardly after it has been established. As the aspirating device 26 is arranged to apply treating liquor to goods first ahead of the air jet, the initial backward ballooning tendency is effectively blocked and thereby prevented from materializing in the goods being circulated so that difficulty with this troublesome condition is entirely avoided.

The air and treating liquor circulating system provided in the apparatus shown by FIGS. 1 and 2 comprises a drain manifold 38 connected at the bottom of vessel 10 with each of the processing stations therein by which a decayed liquid phase portion of the foamed processing liquor is recovered for recycling. This drain manifold 38 runs to the suction port of a motor-driven pump 40 that delivers through a filter unit 42, for removing lint or the like, to a heat exchanger 44 and a parallel by-pass line 46 to which the heat exchanger discharge line returns at 48. The discharge line 48 from heat exchanger 44 has a tap line 50 branching therefrom for selective delivery to a jacket space at each processing station in vessel 10, as will be noted further presently, while the by-pass line 46 continues to a processing liquor manifold 52 from which the feed connection 30 to the aspirating devices 26 at processing station is provided, as well as similar alternate connections (not shown) that may be selectively used to feed foam generators arranged at each processing station as described more fully further below.

Figure 4:
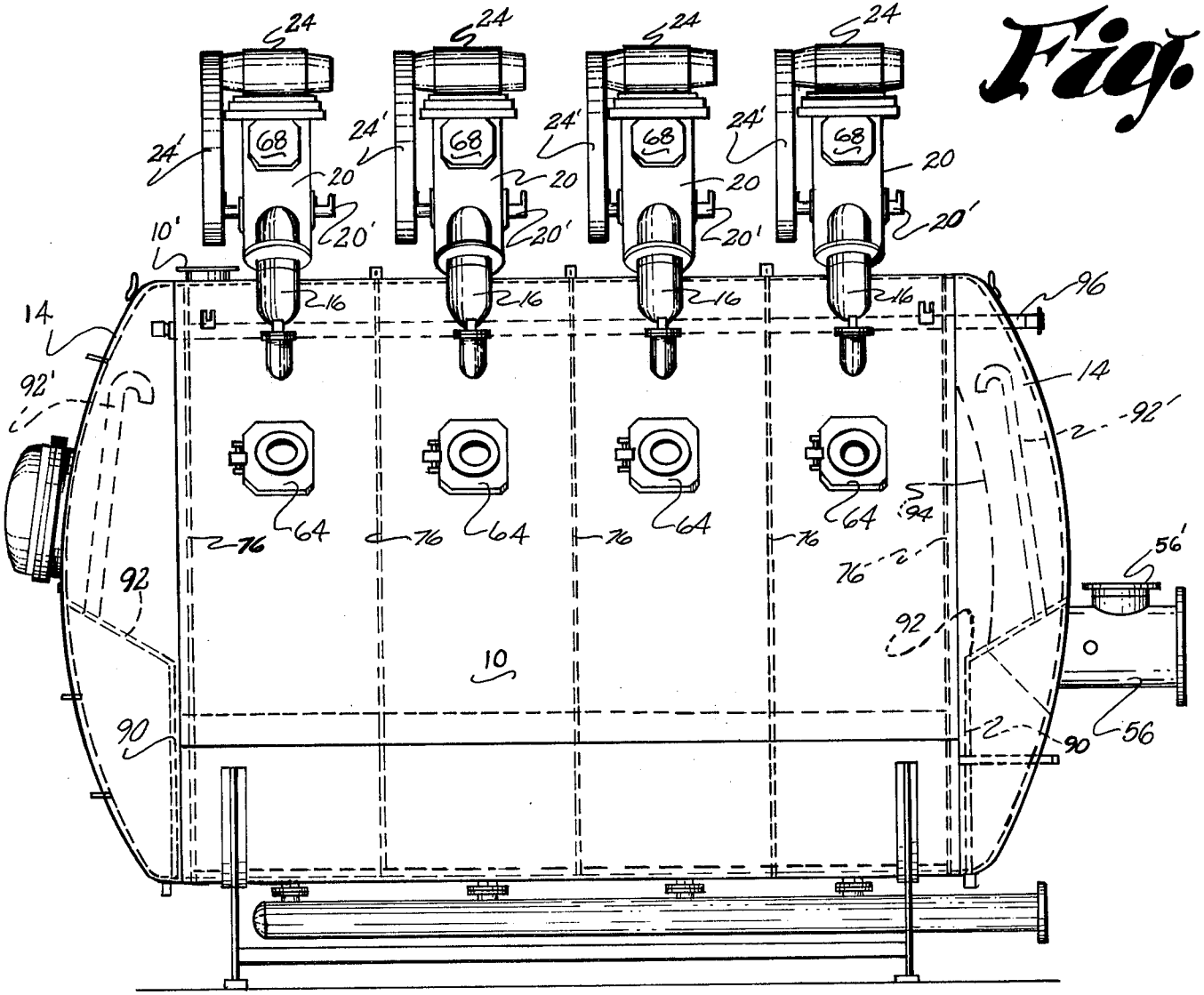
FIG. 4 is a further left side elevation corresponding generally to FIG. 3.

For air circulation a motor-driven blower 54 is provided that draws through a connection 56 from the interior of vessel 10 and delivers to an air manifold 58 from which the air supply connection 34 to each aspirating device 26 branches. In order to maintain horsepower demand and mass flow level despite the substantial temperature variation encountered during a processing cycle, the suction leg 56 from vessel 10 to blower 54 has a temperature-sensitive damper operating means 60 installed thereat (compare FIGS. 2 and 5) for throttling the air flow appropriately. Also, as seen in FIG. 4 the blower suction leg 56 and the top of vessel 10 at its opposite end are fitted with flanged ports 56' and 10' that may be employed usefully whenever the apparatus is being operated for bulking heat treatment, as disclosed and claimed in copending application Ser. No.

604,167, filed Aug. 13, 1975. For this purpose, after the heat teatment for bulking has been completed, the vessel 10 can be cooled quite readily and advantageously by opening both of these ports 56' and 10' so that continued operation of blower 54 will result in drawing atmospheric air into the system, while port 10' will allow discharge from vessel 10 to effect ventilation and cooling thereof.

For use in loading and unloading piece goods before and after processing a driven reel arrangement 62 is mounted on vessel 10 by an extending bracket structure, and vessel 10 is fitted with access ports 64 at each processing station for such loading and unloading. In addition, sight glass fittings 66 and associated lamps are arranged externally on vessel 10 at each processing station in order to illuminate the vessel interior sufficiently to allow visual monitoring of an operation in progress. Further access ports 68 are also provided at the superstructure housing portions 20 to allow the lifter rolls 22 to be reached for any necessary attention, and a manhole 70 is provided at the lefthand head of vessel 10 to allow access to vessel interior whenever required.

Figure 3:
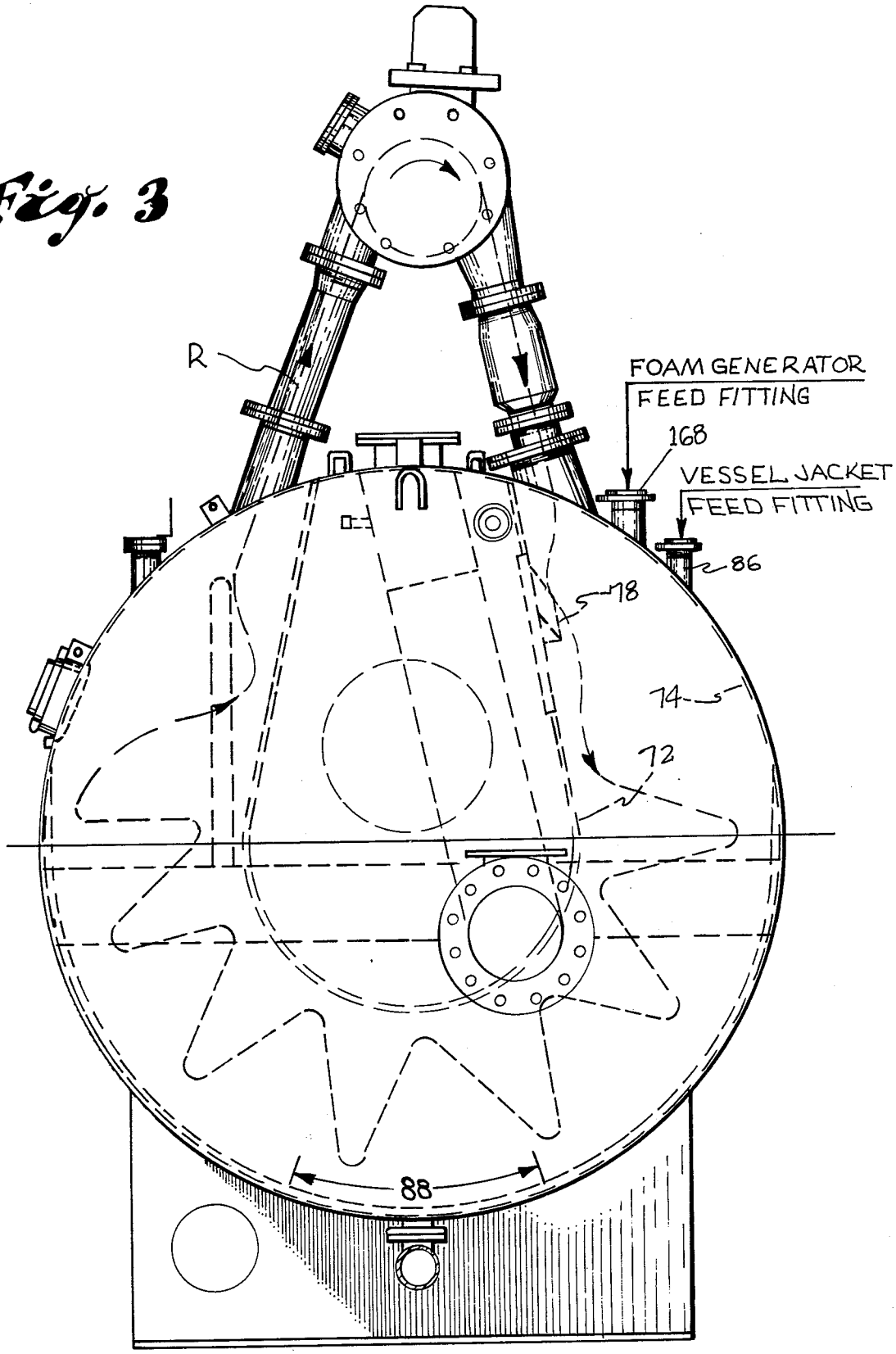
FIG. 3 is a further end elevation of the FIG. 1 apparatus in which internal structural arrangement is further indicated.
Figure 8:
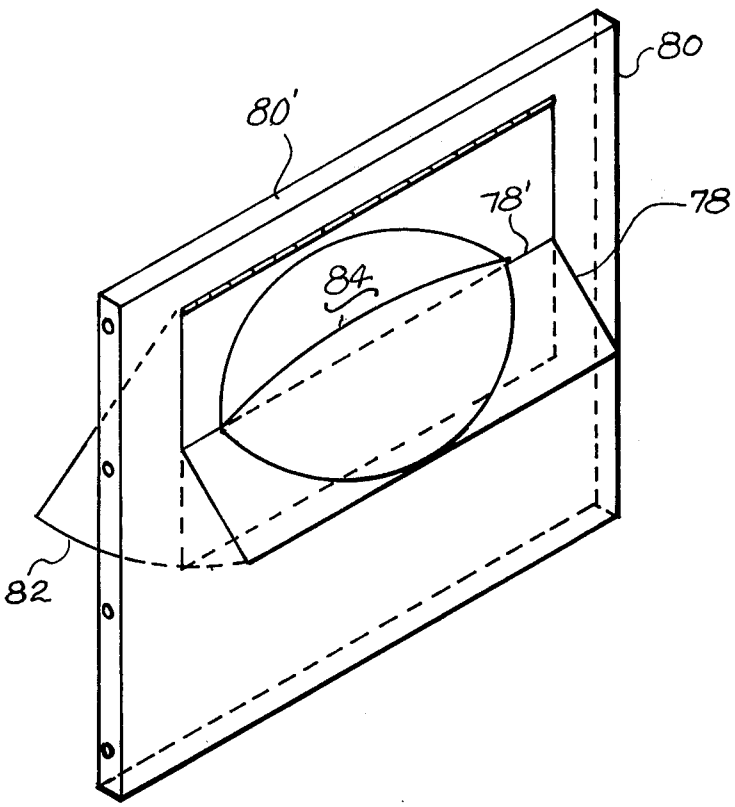
FIG. 8 is a perspective detail of the deflector plate provided to effect orderly piling of the recriculating fabric as it is returned to the processing vessel for transient storage.

FIGS. 3 and 4 of the drawings illustrate further the interior structural and operating arrangement of the apparatus by which provision is made at each processing station for recirculating the endless piece goods rope whose general path of travel is indicated in FIG. 3 at R. For transient storage of the major portion of the recirculating rope R the vessel 10 has chamber of J-box configuration formed therein at each processing station between spaced inner and outer shells 72 and 74 and vertical side partitions 76 closing the spacing between the shells 72 and 74. Adjacent the entrance portion of this J-box chamber at which the piece goods rope R is returned for storage therein, the inner shell 72 has an adjustable deflection plate or box means 78 installed therein in a form that is indicated best in FIG. 8.

This plate or box means 78 includes a supporting frame member 80 on which the deflection plate or box 78 proper is hinged at its upper edge as indicated at 80' for angular adjustment in relation to the plane of the inner J-box shell 72 to increase or lessent its relative projecting position for rope deflecting action. The deflection plate or box 78 has a transverse angular vend 78' about midway of its depending width and right angular side portions 82 guiding its angular projecting adjustment, which may be set from any suitable operating articulation (not shown) arranged for manipulation at the exterior of vessel 10.

At the face of deflection plate or box 78 that is directed inwardly of the J-box inner shell 72 and with the angular bend 78 therein as an axis, a transversely oriented protrusion 84 is formed so as to be located in the path of the piece goods rope R as its returns to the J-box chamber. The action of this convex protrusion 84 when projection of th plate or box 78 is properly adjusted for the goods being handled is to cause a random side to side deflection to the rope R into the J-box chamber that results in directing exceptionally orderly storage piling or plaiting of the returning rope R in the J-box chamber for advantageous stored movement therethrough.

Movement of the stored portion of rope R is also facilitated by forming the J-box chamber so that the spacing between the side partitions 76 exceeds that between the inner and outer shells 72 and 74. For example, where the vessel 10 has an 8' diameter it has been found advantageous to provide a 30" spacing between the side partitions 76 in relation to one of 24" between the J-box shells 72 and 74, because good storage piling of the rope R in the J-box chamber has not only been found to be accommodated better by such proportioning but movement of the stored pile through the J-box chamber also proceeds more readily.

In connection with the J-box chamber it should also be noted that the outer shell 74 thereof is installed within the vessel 10 at a spacing leaving a jacket space between this shell and the inner vessel wall, and that the vessel 10 is fitted with a feed port 86 to the jacket space for selective use in supplying a portion of the processing liquor thereto through tap lines 50 for heat transfer purposes, as will be noted further presently. Also, it should be noted that the inner and outer shells 72 and 74 and the side partitioning 76 forming the J-box chambers are imperforate except for a restricted arcuate portion, indicated at 88 in FIG. 3, at the bottom of outer shell 74 that is perforately formed to allow draining and recovery of decayed liquid phase processing liquor therefrom for recycling.

Where the vessel 10 is fitted with pressure heads 14 for high temperature operation, the vessel interior is also specially fitted thereat (see FIG. 4) by installing vertical walls 90 at a bottom segment of the heads 14 to prevent disproportionate loss of the relatively small amount of processing liquor available at the low liquor ratios employed according to the present invention, through drainage into the pressure heads 14. The liquor excluding wall segments 90 within pressure heads 14 have inwardly slanted top partitions 92 arranged thereat to complete the liquor exclusion structure. Extended gooseneck fittings 92' are provided at the top partition 92 to equalize pressure within the head partitioning while guarding against liquor entrance by this route. Additionally, at the pressure head 14 on which the blower suction leg 56 is installed an interiorly extending air conduit structure 94 opens through the top partition 92 thereat and reaches within this head 14 to the top portion of vessel 10, adjacent a spray line 96 through which sufficient supply of processing liquor is directed to maintain the interior wall surfaces of vessel 10 wet during operation and thereby prevent any accumulation of objectional deposits in this area which may otherwise develop during the processing cycle.

Figure 5:
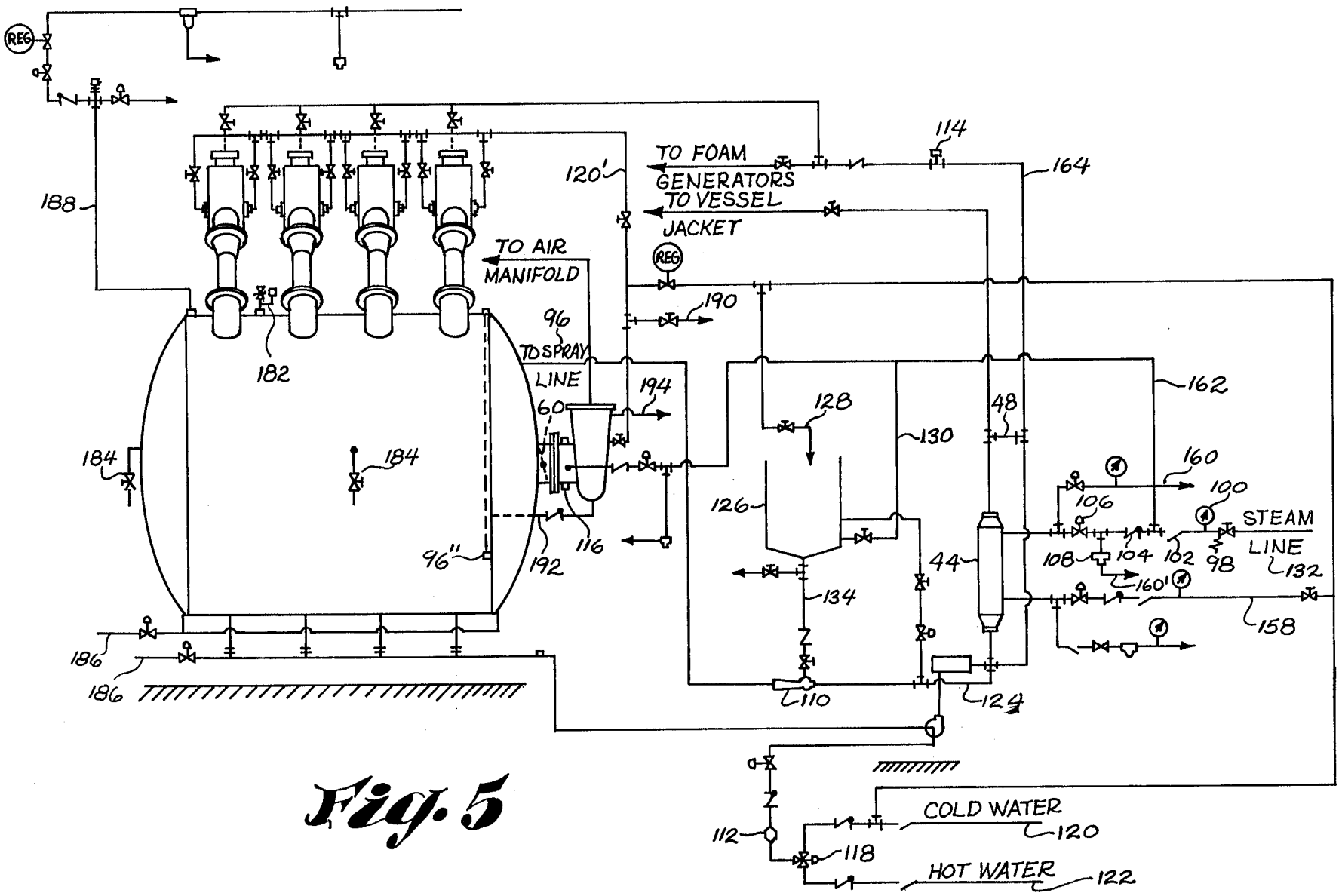
FIG. 5 is a schematic piping diagram of the apparatus.

FIG. 5 of the drawings shows a schematic piping diagram of the operating system in relation to which the manner of operation may be described further. In this FIG. 5 diagram the symbols used represent, respectively, a manually operated valve as at 98; pressure gauge as at 100; a strainer as at 102; a check valve as at 104; a control operated valve as at 106; a steam trap as at 108; an eductor as at 110; a water meter as at 112; a vacuum breaker as at 114; a temperature sensor as at 116; and a three-way blend valve as at 118. To initiate a typical processing operation with the system illustrated a suitable addition of water is first directed to the vessel 10 from the cold and hot water supply lines 120 and 122 through blend valve 118, adjusted to provide a suitable addition temperature, by operating pump 40 connecting the flow therefrom through filter 42 to add line 124 which delivers to vessel 10 at the previously mentioned spray line 96, a level sensing device 96" is provided in vessel 10 to monitor the water addition made. When the water addition has been made, piece goods is loaded at the several vessel processing stations, and after the ends of the loaded goods are sewn to form endless loops thereof, circulation of these piece goods loops is commenced by rotating the lifter rolls 22.

Assuming the processing operation is to be carried out for dyeing, a suitable dyestuff formulation is prepared in add tank 126. For this purpose, a branch 128 from cold water supply line 120 is available for any additional formulating water needed, or such water can be obtained by operating pump 40 to draw from the water already added in vessel 10 to obtain what is needed through drain manifold 38 and direct it to add line 124 and branch line 128 to add tank 126. In the course of preparing the dyestuff formulation to be used suitable foaming agents are included to render the formulation a foaming one for the purposes of the present invention as previously mentioned. If any preheating is needed for temperature adjustment of the formulation in add tank 126, this may be done by admitting steam through a branch line 130 connected with steam line 132. Once the dye-stuff formulation has been satisfactorily prepared in add tank 126 it is dropped therefrom through line 134 to eductor 110 at which circulation from pump 40 through add line 124 causes addition of the prepared foaming formulation to vessel 10 at spray line 96. When this addition has been made recycling of the processing liquor is commenced by causing pump 40 to deliver through heat exchanger 44 and by-pass line 46 in suitable proportions.

In this latter connection the particular form of heat exchanger 44 employed should be considered because of the special arrangement for effective operation despite the limited amount of processing liquor available for recycling in view of the low liquor ratio at which processing is conducted according to the present invention. This is significant because of the need to maintain turbulent flow through a heat exchanger for good operation and with limited liquor available such flow cannot be obtained unless special arrangements are made to do so. The special arrangements made according to the present invention are detailed in FIGS. 9 and 10 of the drawings in which the heat exchanger 44 is shown as comprising a tubular shell 136 housing a tube bundle indicated generally in FIG. 9 at 138 installed between tube mounting sheets or plates 140.

Figure 9:
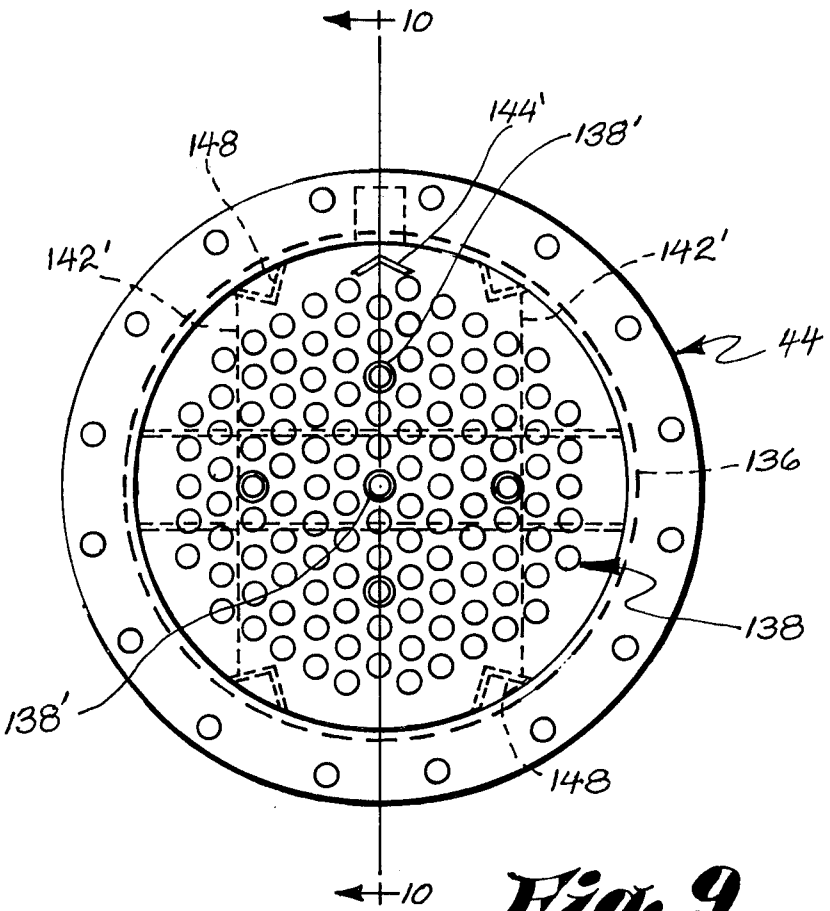
FIG. 9 is a sectional plan view of special form of heat exchanger employed in the processing system as seen substantially at line 9—9 in FIG. 10.
Figure 10:
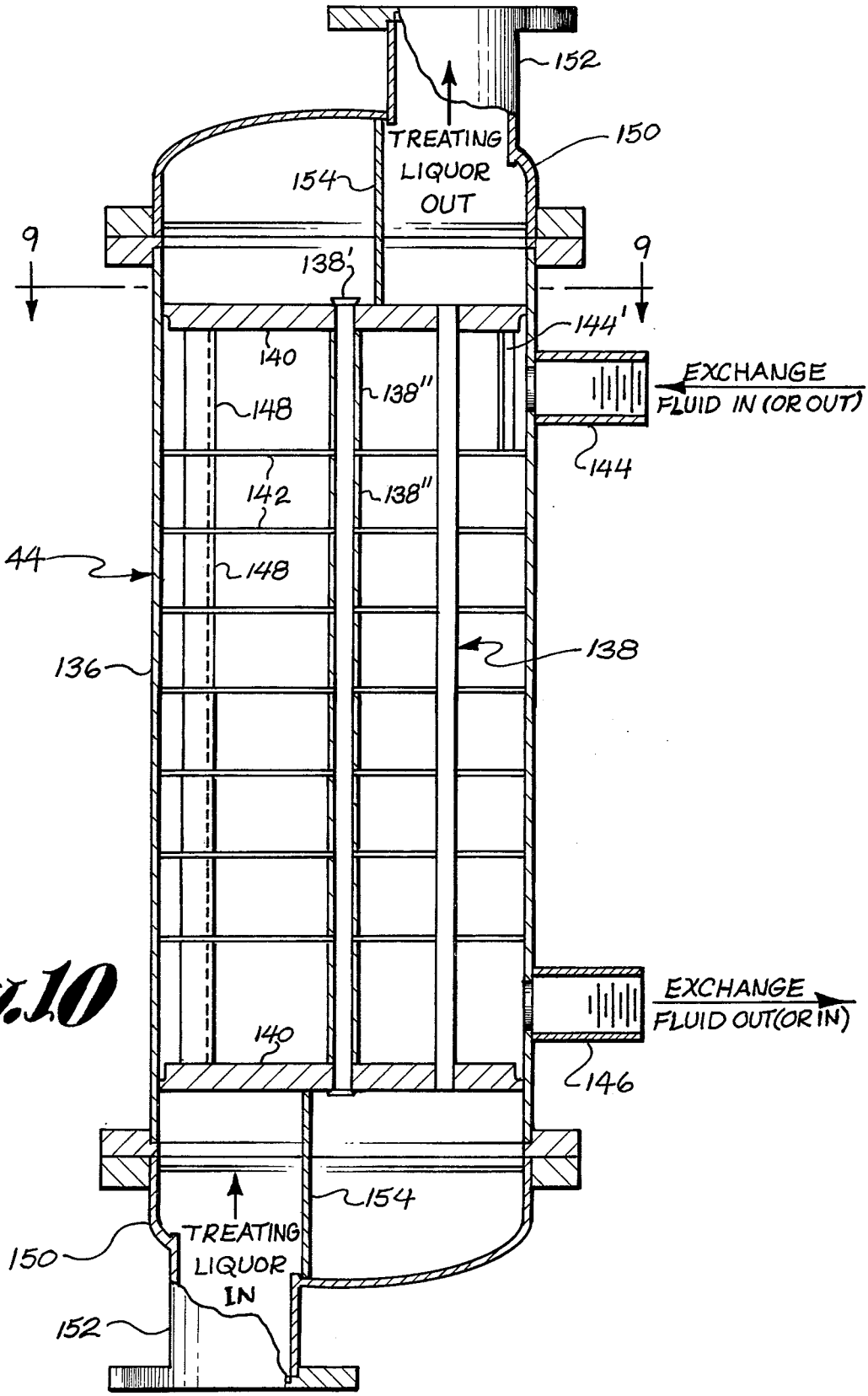
FIG. 10 is a central vertical section of the FIG. 9 heat exchanger taken substantially at line 10—10 in FIG. 9.

Certain tube elements of the bundle 138, specifically the central tube element and four others spaced symmetrically therearound as indicated at 138' in FIG. 9, have the ends thereof flared at the outer faces of the tube sheets 140 and have tubular spacers 138'' assembled thereon between the tube sheets 140 for spaced positioning of exchange fluid baffle plates 142 in relation to the tube bundle 138. These baffle plates 142 are arranged in relation to an exchange fluid inlet fitting at 144 and an outlet fitting 146. The baffle plates 142 are of circular configuration with peripheral portions thereof alternately segmented as indicated at 142' in FIG. 9 so that the exchange fluid is caused to cascade downwardly in the shell 136 from side to side transversely through tube bundle 138 at each step.

An angular impingement member 144' is installed facing the exchange fluid inlet 144 for initial dispersion purposes and aligned spacing angle elements 148 are installed at opposite sides of the baffle plates 142 to assemble them securely within the shell 136. The heat exchanger assembly is completed by heads 150 attached at opposite ends of shell 136 through which processing liquor is respectively delivered to and withdrawn from the tube bundle 138 during its recycling flow. These heads 150 are formed with respective delivery and withdrawal ports 152 at off-center locations and have flow divider plates 154 fixed at chordal positions therein for directing processing liquor flow through approximately one-third of the tube bundle 138 so that this flow progresses through the tube bundle 138 in three passes, and the flow rate of the limited liquor supply is thereby maintained high enough to maintain the desired turbulence in tube bundle 138.

The steam line 132 is used to supply exchange fluid to the heat exchanger 44 for heating purposes, while the outlet is connected to drain line 156 during heating. For cooling, a supply connection is made through branch line 158 from water line 120, while draining is done at 160. It may also be noted at this point that steam line 132 is additionally fitted with a condensate chain line 160' and has a connection 162 running to the suction leg of blower 54 for heat treatment use when the system is used for bulking prior to wet processing, as mentioned earlier.

The output from heat exchanger 44 is handled variously depending on the processing conditions desired for the particular piece goods being handled. If the goods are such as not to be adversely affected by impinging jet application of processing liquor thereto the heat exchanger output is directed entirely to mainfold 52 and supplied therefrom through feed connections 34 to the first stages of the aspiration devices 26 at the several processing stations. At the same time the blower 54 is operated to employ the aspirating devices 26 fully in receiving the circulating piece goods rope R from the lifter roll 22, applying the processing liquor thereto, and returning the rope R having the liquor applied thereto to the adjacent entrance portion of the rope storage J-box chamber provided in vessel 10. Both the jet application of the processing liquor and the agitation incident to return of the piece goods rope R to the vessel J-box chamber cause foaming of the processing liquor formulation to expand its influence on the transiently stored portion of the piece goods rope R, as mentioned earlier. Because the processing liquor is provided in a non-persistently foamed condition, enough of the applied liquor will decay to liquid phase during progress of the stored piece goods through the J-box chamber to allow recovery and continual recycling for reapplication, although movement of the stored piece goods and particularly the ultimate withdrawal of the piece goods rope R by lifter roll 22 involve enough continued agitation to cause some of the foam to persist through the entire piece goods storage movement so that the effect is to influence the full piece goods movement as if more processing liquor were present than is actually available at the low liquor ratios employed.

Figure 6:
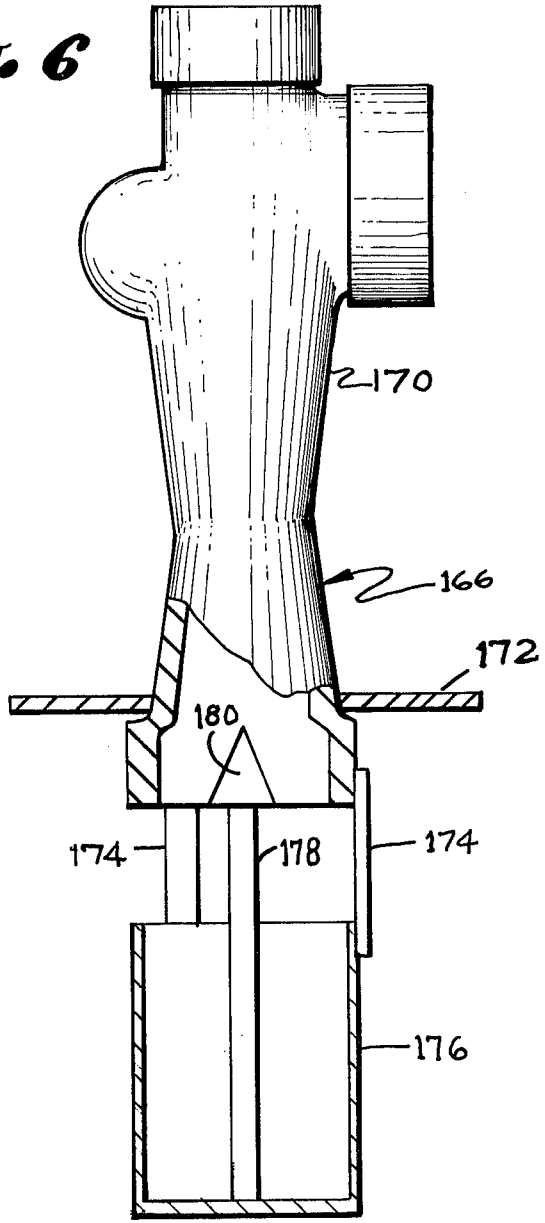
FIG. 6 is a detail of the foam generator fitting provided for selective use in foaming the processing liquor for application.

In instances where the piece goods being handled is more sensitive to impinging jet application of the processing liquor, the heat exchanger output to manifold 52 is throttled to reduce the jet influence to a tolerable level and a supplementary application of processing liquor is made through a branching manifold 164 which supplies foam generators 166 installed at each processing station in ports 168 (see FIG. 3) provided on vessel 10 adjacent the point at which the circulating piece goods rope returns to the vessel J-box chamber for storage. The form of the foam generators is indicated in FIG. 6 of the drawings as comprising a delivery fitting 170 that may be an eductor, as illustrated, supplied with motivating air through a tap line (not shown) from the blower system, but that has been found to serve just as satisfactorily if simply arranged as a tubular inlet. In either case the delivery fitting 170 carries a flange 172 at which it is mounted at the vessel port 168 provided therefor and from which mounting it extends inwardly to have spaced hanger straps 174 fixed thereto that are attached to carry a cup member 176 in spaced depending relation below the delivery fitting 170. At the bottom of the cup member 176 a rod element 178 is fixed at a central upstanding position and has an enlarged conical head portion 180 thereon arranged with the apex thereof facing in the direction opposite to that in which processing liquor is fed through the delivery fitting 170. The conical head portion 180 serves to spread the delivered processing liquor so that its foam generating turbulence is increased as it is caught in cup member 176, and th foamed processing liquor then simply overflows from the cup member 176 to fall therefrom into the entrance portion of the vessel J-box chamber for application to the piece goods thereat.

When the aspirating device 26 are throttled and supplemented by use of the foam generators 166 in the foregoing manner, it will also usually be necessary to divert some of the heat exchanger output through the tap line 50 to feed fittings 182 provided on vessel 10 at each processing station to connect with the jacket space arranged therein exteriorly of outer J-box shells 74, in order to make certain that sufficient heat exchange with the circulating piece goods rope R is obtained to move through the processing cycle effectively. An ultimate processing alternative is to circulate the piece goods rope R through the vessel superstructure through use of the lifter roll 22 along, or with just air supply to the aspirating devices 26, and apply all of the processing liquor to the piece goods rope R through the foam generators 166, while also using the tap line 50 to feed the vessel jacket space to maintain proper heat exchange conditions for the processing.

With final reference to FIG. 5 it may be noted that vessel 10 is provided with suitable relief and vacuum breaking devices at 182; with manual valves 184 that may be employed to check on full pressure release; with drain connections to waste at 186; and with an air pad control system at 188 for pressure regulating purposes. Also, it should be noted that the raw water supply line 120 is connected at 120' to provide cooling water at the bearings for the lifter rolls 22 in superstructure housing 20 and for the blower 54, as well as having a branch connection at 190 to a seal at pump 40. In addition, blower 54 is fitted with a drain connection at 192 through which any entrained processing liquor collecting therein may be returned to vessel 10, as well as having a drain connection 194 to waste for use when needed.

The present invention has been described in detail above for purposes of illustration only and is not intended to be limited by this description or otherwise to exclude any variation or equivalent arrangement that would be apparent from or reasonably suggested by the foregoing disclosure to the skill of the art.

We claim:

1. In apparatus for low liquor ratio wet processing of textile fabric in endless loop form while recirculating the fabric loop through a processing system including a vessel arrange for transiently storing a major portion of said fabric loop and a superstructure for said vessel disposed and equipped for progressively withdrawing the fabric loop from and returning it to the vessel storage to effect said fabric recirculation, the improvement with comprises a lifter roll and selectively operable aspirating means housed in said superstructue and to cause recirculating travel of the fabric loop, a foam generator mounted on said vessel, means for applying a low liquor ratio foaming formulation of the processing liquor externally to said recirculating fabric in a non-persistently foamed condition by feeding processing liquor under pressure selectively to either or both of said aspirating means and said foam generator adjacent the point of fabric return to said vessel storage so that the foamed processing liquor tends to decay to liquid phase in the course of migratory saturation of the stored fabric portion as it progresses through said vessel, and means for recovering a decayed liquid phase of said foamed processing liquor from said vessel and for continually recycling the recovered liquor to said applying means for reapplication to non-persistently foamed condition to said recirculating fabric.

2. In apparatus for low liquor ratio wet processing of textile fabric, the improvement defined in claim 1 wherein said superstructure is formed by respective intake and discharge leg portions that are symmetrically inclined upwardly from said vessel and are joined at their upper ends through a cylindrical housing, wherein said lifter roll is rotatably disposed in said housing for operation to progressively withdraw said fabric loop from the vessel storage, and wherein said aspirating means is mounted in said discharge leg portion for directing said fabric loop as it is returned to said vessel storage.

3. In apparatus for low liquor ratio wet processing of textile fabric, the improvement defined in claim 1 wherein said aspirating means is a two-stage device comprising a two-part tube through which said fabric loop is drawn during recirculating travel thereof, an initial part of said tube having a tapered exit end portion concentrically spaced within a correspondingly tapered housing to form a jet nozzle through which processing liquor may be delivered from a first plenum chamber surrounding said initial tube part and to which processing liquor may be fed under pressure, a terminal part of said tube being surrounded by a second plenum chamber to which inert gas may be fed under pressure and having an exit end portion concentrically spaced within a tubular outlet from said second plenum and at which terminal end portion a plurality of parallel flow directing vanes are disposed.

4. In apparatus for low liquor ratio wet processing of textile fabric, the improvement defined in claim 1 wherein said foam generator comprises a processing liquor delivery fitting mounted on said vessel in relation to the point of fabric return to said vessel storage from said superstructure, said delivery fitting extending within said vessel from the mounting thereon and having a plurality of spaced hanger straps fixed on the extending portion thereof and attached to carry a cup member in spaced depending relation from said extending portion, and a rod element fixed at the bottom of said cup member at a central upstanding position therein and terminating upwardly in an enlarged conical head having the apex thereof facing in the direction opposite to that in which processing liquor is fed to said foam generator through said delivery fitting.

5. In apparatus for low liquor ratio wet processing of textile fabric, the improvement defined in claim 1 wherein said vessel is arranged interiorly with a chamber of J-box configuration for transiently storing said major fabric loop portion and includes an adjustable deflection plate member as part of said J-box chamber adjacent the entrance portion thereof at which said fabric is returned from said superstructure for storage, said deflection plate member having a transversely oriented convex protrusion at the face thereof directed inwardly of said J-box chamber and located in the path of said returning fabric to direct orderly storage piling of the returning fabric in said J-box chamber.

6. In apparatus for low liquor ratio wet processing of textile fabric, the improvement defined in claim 1 wherein said vessel is arranged interiorly with a chamber of J-box configuration for transiently storing said major fabric loop portion, said J-box chamber being formed within said vessel between inner and outer interiorly disposed shells and partitioning side walls connecting said shells, and the spacing between said side walls exceeding the spacing between said shells.

7. In apparatus for low liquor ratio wet processing of textile fabric, the improvement defined in claim 6 wherein said vessel is a pressure vessel formed cylindrically about a horizontal axis and having dished head members of pressure resisting form closing each cylindrical end of said vessel, and wherein each of said dished head members have a bottom segment thereof fitted interiorly with a vertical wall and inwardly slanted top partition preventing access of processing liquor to said bottom head segments.

8. In apparatus for low liquor ratio wet processing of textile fabric, the improvement defined in claim 6 wherein the outer shell provided in forming said J-box chamber within said vessel is spaced interiorly of said vessel so as to form a jacket spaced between said outer shell and the wall of said vessel, and wherein means is provided for selectively supplying a portion of said processing liquor to said jacket space for heat transfer purposes.

9. In apparatus for low liquor ratio wet processing of textile fabric, the improvement defined in claim 6 wherein said inner and outer shells and partitioning side walls forming said J-box chamber are imperforate except for a restricted arcuate portion at the bottom of said outer shell that is perforately formed to allow draining and recovery of decayed liquid phase processing liquor therefrom for recycling.

10. In apparatus for low liquor ratio wet processing of textile fabric, the improvement defined in claim 1 wherein said means for recovering and recycling a decayed liquid phase of said foamed processing liquor includes a heat exchanger comprising a tube bundle housed within a tubular shell through which heat exchanging fluid is circulated in relation of said tube bundle and heads attached at opposite ends of said shell and at which said processing liquor liquid phase is respectively delivered to and withdrawn from said tube bundle during said recycling, said heads being formed with respective delivery and withdrawal posts at off-center locations and having flow divider plates fixed at chordal positions therein for directing processing liquor flow through approximately one-third of said tube bundle so that it progresses through said tube bundle in three passes.

11. In apparatus for low liquor ratio wet processing of textile fabric the improvement defined in claim 1 wherein the processing liquor is employed at a ratio not exceeding about 1:5 and is a dyestuff formulation.

* * * * *